United States Patent [19]

Poncelet et al.

[11] Patent Number: 4,714,626

[45] Date of Patent: Dec. 22, 1987

[54] PROCESS FOR TREATING CONDUCTIVE PROFILES, PARTICULARLY METALLIC CONDUCTIVE WIRES, THE INSTALLATION FOR CARRYING SAID PROCESS INTO EFFECT, AND TREATED PROFILES SO OBTAINED

[75] Inventors: André Poncelet, Ville Houdlemont; Hyacinthe Getti, Herserange; Michel Faugouin, Gorcy, all of France

[73] Assignees: Tecnor, Puteaux; Sa "PGF"Procede de Galvanisation de Fils, Gorcy, both of France

[21] Appl. No.: 819,224

[22] Filed: Jan. 15, 1986

[30] Foreign Application Priority Data

Jan. 22, 1985 [FR] France ..... 85 00852

[51] Int. Cl.[4] ..... C23C 2/00; C23C 2/38

[52] U.S. Cl. ..... 427/49; 118/620; 427/433

[58] Field of Search ..... 427/49, 82; 118/620, 118/43

[56] References Cited

U.S. PATENT DOCUMENTS 2,286,194 6/1942 Bradley ..... 427/49

FOREIGN PATENT DOCUMENTS 888791 7/1953 Fed. Rep. of Germany ..... 427/49
2818155 11/1979 Fed. Rep. of Germany ..... 427/49
385971 4/1930 United Kingdom ..... 427/49

*Primary Examiner*—Sam Silverberg
*Attorney, Agent, or Firm*—Felfe & Lynch

[57] ABSTRACT

A process for treating continuous elements or wires made of electrically conductive materials, wherein said elements are passed through a liquid treatment bath. It is characterized by the fact that, before immersing them in said bath, said elements or wires are heated up to a temperature by supplying electric current through a contact bath upstream said treatment bath. A preliminary bath is preferably provided and the contact bath is brought to a high voltage with respect to both the treatment bath and the preliminary bath. Regulation of the temperature of the each individual element entering the treatment bath may be performing by controlling the current intensity so as to maintain constant the electric resistance of the element there.

10 Claims, 1 Drawing Figure

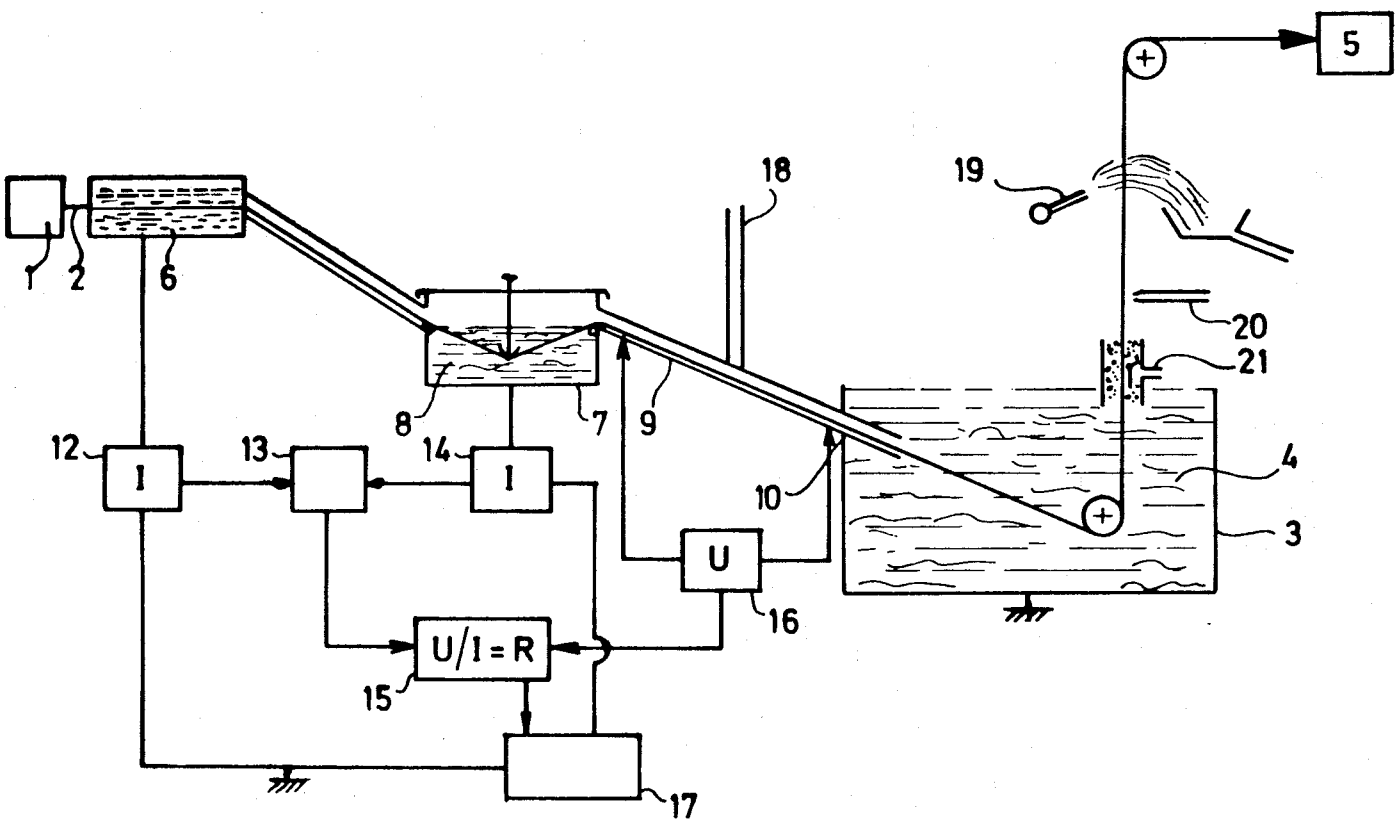
5
19
20
21
4
3
18
10
16
U
9
7
17
I
14
U/I=R
8
15
13
6
I
12
2
1

PROCESS FOR TREATING CONDUCTIVE PROFILES, PARTICULARLY METALLIC CONDUCTIVE WIRES, THE INSTALLATION FOR CARRYING SAID PROCESS INTO EFFECT, AND TREATED PROFILES SO OBTAINED

The present invention concerns the technological field of the coating of conductive continuous elements (or profiles), particularly of metallic wires or similar elements. It has more especially for subject-matter a process for treating conductive lengthy elements, or profiles, particularly metallic wires, such a process allowing to achieve, on such elements, a coating made of at least one electrically conductive material. It will be understood that such a process is applied, in a more particularly advantageous manner, to the treatment of metallic wires, and more broadly speaking, of wires or other lengthy elements made of electrically conductive materials, by metallic coatings, the more particularly preferred embodiment of the invention concerning the coating of steel wires by zinc, by the so-called galvanizing technique.

The invention concerns also an installation which allows to carry into effect the aforesaid treatment.

It has also for subject-matter the coated wires which are obtained by the process or in the installation according to the invention.

It is intended in the present specification, that the treatment of so-called profiles includes, not only the wires, strictly speaking, but more generally speaking, all the products constituted by an electrically conductive material which present them-selves under a form having a relative length rather large, so that it is possible to treat them while they are slid through treatment baths. This is applied whatever the cross-section of said profiles. The latter may be as well wires having a circular cross-section as flat steel strips, flat steel sheets, profiles of various sections, as any other lengthy elements, which are known as capable of being slid through a treatment installation, being unwound, especially from supply coils, then rolled up on take up coils, at the delivery end of the installation, or conditioned by cutting in lengths.

The treatment of these sections is carried into effect by baths of electrically conductive materials, which are in a liquid state under the conditions of the treatment. As a rule, but in a no exclusive way, these baths are made of molten metal or metallic alloy.

In the field of the galvanizing of steel elements, such as steel wires, to which the invention is particularly directed, it is usual to slide (i.e. draw) wires through an installation in which the chief step is that of the properly so-called galvanizing step and the wires are passed through a tank containing a bath constituted of heated zinc under the liquid state. Just upstream the tank, a pre-heating of the wires is generally performed at a temperature which is rather distinctly lower than that of the zinc bath. So doing, the oxydizing of the wires in the ambient air is avoided. At the outlet of the treatment bath, i.e. downstream, these wires are cooled, for instance by water sprinkling, and by air circulating, or by a combination of both techniques, before being rolled up on take up coils.

This galvanizing steps may be performed in series with classical treatments which aim at improving the mechanical properties of steel, which involves to pass the wires through an annealing furnace, of the tunnel type, possibly through a quenching bath, and then via cooling, etching, rinsing stages, before reaching the aforesaid pre-heating and the zinc bath itself.

The techniques which have been carried into effect hitherto did not give completely satisfaction, for reasons which are directly connected to the way the chemical reaction leading to the coating is achieved.

It appears that adherence of the zinc coating on the wire is wrongly influenced by the nature and the structure of the first layers of iron-zinc allow which are formed on the steel surface when entering the bath, the temperature of which is most often about 450° C.

In order to obtain strongly adherent zinc coatings, it is essential to use fully killed or semikilled steels, as effervescent or unkilled steels or steels from mini-steelworks do not give satisfactory results in adherence tests.

In order to take into account the present situation, and, more particularly, the accelerated development of short dies producing steels which are cheap and of lesser quality, other dip galvanizing techniques become necessary.

It has been proposed to use a nitriding and reducing atmosphere for preparing the steel surface and introducing it at a temperature running to 720° C. in the molten zinc which constitutes the treatment bath. However, it is out of the question to choose a higher temperature because the wire temperature cannot be maintain constant from the outlet of the heating furnace to the inlet of the zinc bath, this being for technicological reasons.

The present invention aims to reduce the aforesaid difficulties. It also allows to improve the mechanical and physico-chemical properties that are usually researched in galvanized steel wires, or, generally speaking, in any continuous element which is coated or treated in a similar manner.

To that effect, the invention has for subject-matter a process for treating continuous elements which are constituted of electrically conductive materials, according to which said elements are drawn throught a liquid treatment bath, characterized by the fact that before their immersion in said bath, said elements are heated by Joule effect by passing through a conductive contact bath which is maintained at a potentiel substantially different from that of said traitement bath and that of a preliminary contact bath.

The elements are preferably heated, in that manner, to a temperature higher than that of said treatment bath, in order to maintain the latter to the useful treatment temperature. Such a heating of the sections to a temperature higher than the vaporization temperature of said bath allows further very often to improve the treatment result.

A liquid bath treatment which is electrically conductive, can constitute one of the contacts between which the current flows through the elements, along the length comprised between the contacts. Thus, before its immersion in said treatment bath, said element is passed through the contact bath.

Before passing in said contact bath, said element is advantageously passed in a degreasing bath; electrical contact are then distributed, as for the first contact, at the level of the degreasing bath, as for the second contact, at the level of said contact bath, and as for the third contact, ensuring with the second one, the heating by Joule effect of said element, at the level of the treatment bath.

In one of the main applications of the process, the continuous element is constituted of a steel element.

Within the scope of its carrying out for the galvanizing, the treatment bath is constituted by a zinc bath. The contact bath preceding the treatment bath may be constituted by a molten metal bath, for example, by a lead bath, or by a bath of liquid electrolyte.

A previous contact bath intended for a degreasing may be constituted by an electrolytical bath. Moreover it can be thought, in this connection, of carrying out any other electrolytical treatment of a known per se type. A periodical polarity reversal allows to alternate, on the element, the cathodic and anodic effects to the treatment.

One among the interests of the invention consists in facilitating the simultaneous treatment of several elements or wires or several wire assemblies. In such a case, the current density is adjusted individually on each element or wire, in case of variation of the sliding speed of said element or wire, in order to maintain the temperature of the heated wire at the constant value desired. Here, every wire or wire assembly may be understood as a plurality of wires or continuous elements, for example sheet wires.

In order to protect it from the corrosive atmosphere and to maintain it, on the contrary, in the environment of zinc vapor, the section is advantageously surrounded by a protective envelope between the contact bath and the treatment bath.

As it was indicated previously, the invention has also for subject-matter an installation for carrying into effect the treatment of electrically conductive continuous elements, and more particularly of metallic wires. This installation comprises a tank containing a liquid treatment bath and means for heating each element before it enters into said tank. Said means for heating said elements comprise a source of electric current, the poles of which are connected to said treatment bath and to a contact bath through which said wires pass upstream on their sliding circuit, respectively.

In a preferred embodiment the installation comprises successively on the circuit followed by the continuous elements a first tank of an electrolytic bath at the electric mass potential, a second tank of an intermediate contact bath at a high potential with respect to said mass and a third tank of a treatment zinc bath which is also at the electric mass potential, and it comprises associated electronic means to control the current applied to each element so as to maintain at a constant value its temperature at the entrance of the treatment bath. In practise it can be advantageous to use as the reference value rather than the temperature itself the result from a resistance measurement involving the tension difference at the ends of the element in its section comprised between the intermediate contact bath and the treatment bath and by referring for different elements to be treated to the relations between the resistance and the temperature which can be stored in computers.

Of course, the invention concerns also the electrically conductive continuous elements, and more particularly the metallic wires treated according to the process of the present invention or obtained in an istallation according to the aforesaid arrangements.

For, illustrative purposes, the present invention will be now described with reference to the drawing which is enclosed to the present specification and which represents a particular embodiment of an installation according to the invention, especially adapted to the treatment of steel wires in order to galvanize them.

The described installation comprises a reserve 1 of non-treated wires, means for putting under tension each wire 2 which leaves the wire reserve 1, a tank 3 which contains the treatment bath 4.

The wire 2, which goes out of the wire reserve 2 and which will be then directed to a rewinding coil 5 at the end of the treatment, can be passed, in a first step, in a device 6 constituting the first electric contact, in a so-called degreasing bath for the electrolytic degreasing of the wire.

Leaving this degreasing device, the wire arrives in a tank 7 which contains a molten metal, for example molten lead, in which a second electrical contact is ensured. Alternatly, the tank 7 can contain an electrolyte, such as an aqueous solution of a strong acid or base (like $S0_4H_2$ or Na OH), which may have a cleaning action on the wire. It can further comprise a rinsing device where the wire leaves the tank.

In going out of this tank 7, the xetallic wire goes via a tunnel, a tube or an envelope 9, which avoids contacting with ambient air, and enters into the tank 3 which contains the treatment bath, for example molten zinc 4, which ensures a third electric contact with the sliding wires.

The potentials, and consequently, the intensity of the current which traverses the wire 2, may be set as a function, on the one hand, of the electrical properties, particularly of the electrical resistance of the wire and of its speed. The potential is the highest at the level of the second contact (lead bath) while the other two are at the electric mass. Between the second contact and the third contact, the circulation of the current along the wire lenght, heats it in such a way that the wire enters into the tank 3, at the place indicated by the reference numeral 10, at a temperature which is the highest one of the installation and which is preferably higher than the vaporization temperature of the treatment bath 4. In the case of zinc, this vaporization temperature is of about 907° C.

In that manner, in the course of its entering into the liquid zinc, a sheath of zinc vapor is formed at the wire surface; this sheath goes back, in the enclosed space 9, along the wire, counter-currently, and it condenses on the colder wire parts upstream, whereby a first under layer of the zinc coating is formed, developed later within the properly so-called bath 4.

After its passage through said bath, the so coated wire is subjected to a gas puff 21, then to an air puff 20, and finally to a sprinkling by water at 19, before being stored via the rewinding coil 5 in a known per se manner.

The process according to the invention, when applied to the galvanizing of steel wires with patenting, is carried out in such a way to heat the wires above the point of steel, i.e. at a temperature above 950° C. As the iron-carbon alloy passes at this stage in the gamma phase, it is avoided that the carbon remains very concentrated in the core of the wires as this usually occurs, mainly with respect to the effervescent steels and also the fully killed or semi-killed steels.

So, it is possible to obtain wires having improved mechanical qualities, whereas comparatively the presence of carbon in the surface layer of the wires in active gamma phase hastens the reaction between iron and zinc, and promotes the adherence of the coating.

From the electrical point of view, it will be reminded that the wires are supplied with current by three contacts:

the first contact, as considered in the present specification, is constituted by an electrolytical degreasing bath which is common with all the wires and is earthed. A periodical polarity reversal at the level of the second contact allows to alternate in the degreasing bath the anodic etching phases and the cathodic etching phases.

the second contact, which is afforded by an ungrounded potential supply, is distributed in a number of individual contacts which is equivalent to the number of wires or sheets, of which the heating must be controlled separately each wire or wire assembly passing through individual conducts, the third contact is constituted by the zinc bath, which is earthed. It is common with the various wires.

As this has been already specified, the highest temperature is found just at the inlet of the zinc bath. The adjustment of this temperature at the desired level may be carried out by means of a computer-assisted closed loop control assembly. In the same way, it will be possible to obtain the current variation by a control assembly. The temperature at the inlet of the treatment bath will depend, of course, of the nature of the material which constitutes this treatment bath. It will then be maintained constant at the value chosen through a control system as described hereinafter with reference to the drawing.

On this drawing reference 18 shows the admission of a neutral atmosphere in the protecting tube 9, reference 21, 20 and 19 shows respectively the gas puff, the air puff, the water sprinkling. The respective voltages are imparted to the three bath by a source of current 17. The current may be continuous current when the intermediate contact bath is a liquid metal, but alternative current is preferably used together with an electrolyte bath.

The quantity to be controlled is the temperature of each individual wire at the entrance 10 into the treatment bath 3, which for a given current supply in the section from the intermediate bath to the treatment bath 3, may still be influenced, for instance, by unavoidable variations in the speed of the wire through the apparatus. However, it is not the temperature itself which is measured, but rather the voltage between the ends of the wire section present in the tube 9, which voltage is detected by the device 16, much more easily than the temperature would be. The intensity of the current flowing through the same section is calculated in 13, as equal to the difference between the total intensity flowing in 14 to the intermediate contact bath 8 and the secondary intensity flowing back in 12 from the preliminary bath 6.

The resistance R calculated in 15 from the voltage and the intensity is used as the reference quantity in the regulation. For each type of wire it is determined by comparison with known curves showing the variation of the resistance depending on the temperature.

In order to protect the wire by a suitable atmosphere, the three contacts are connected preferably each other by tight and insulating conduits which allow the passage of the wire and limit the losses by convection and radiation.

Another advantage which is procured by the invention consists in the dimensions of the new installation. As a matter of fact, the methods according to the prior art required installations which, usually, were 100 m long. The installations according to the invention can now be arranged on lengths lower than 20 m.

Furthermore, the treatment tank itself presents a reduced size, because, as reactions between the metal constituting the wire and the treatment bath are very quick, the lenght of this tank is highly reduced.

A second advantage of the invention consists in the energy balance, as coefficients running to 7 to 8 can be obtained. In the new process which is presently carried into effect, the calories are brought to the treatment bath by the wire and it is no longer required to heat, for example the zinc tank in the case of the galvanizing process, during working. Only a heating device compensating for the losses during the break of the installation is required. Besides, this allows the using of a tank made of ceramics, the life time of which is unlimited.

The coated wires, particularly the galvanized steel wires, which are made by the process according to the present invention, present mechanical and chemical properties, which are remarkable owing to the excellent adherence of the coating, for example of zinc, on the wire.

By way of illustration, it can be noticed that it is possible, with low carbon content wires obtained by the process according to the invention, to roll up said wires their proper diameter. without any risk of crackle of the coating, which was not the case with the wires obtained by the methods according to the prior art.

Of course, the present invention is in no way limited by the particular details which have been specified in the foregoing or by the details of the specific embodiment which has been chosen to illustrate the invention. All sorts of variants may be brought to the particular embodiment which has been described by way of example and to its constituent elements without departing in any way from the spirit of the invention. So, the invention embraces all the means which constitute technical equivalents of the described means together with their combinations.

It will be understood for example that the treatment of white or bright wires can be carried out by the same technique, but at lower temperatures. Besides it is very easy to work the installation alternately with white or bright wires and with patented wires, the potential variation applied to the second contact bath being sufficient to modify the wire temperature at the inlet of the treatment bath.

What is claimed is:

1. A process for coating continuous elements made of electrically conductive material, comprising:

drawing said elements through a series of stages comprising successively passing said elements through a preliminary degreasing bath of an electrolytic solution, an intermediate contact bath of electrolytically conductive liquid, and a treatment bath of a liquid metal to be deposited on said elements, and bringing said preliminary bath, said intermediate contact bath, and said treatment bath to different voltages making an adjustable heating current circulate along a section of said elements between said intermediate contact bath and said treatment bath and maintaining thereby said treatment bath metal in the liquid state and periodically reversing relative to a first contact at the level of the degreasing bath, the polarity of a second contact, at the level of the contact bath and relative to a third contact, at the level of said treatment bath.

2. The process according to claim 1, which comprises maintaining the temperature of each individual element in a plurality of continuous elements drawn to said treatment bath at a constant temperature at its entrance to said treatment bath by regulating the current supply in the contact bath.

3. The process according to claim 1, in which the elements are heated up to a temperature which is higher than the vaporization temperature of the treatment bath.

4. The process according to claim 1, in which each of said elements is constituted by a metallic wire.

5. The process according to claim 1, when applied to the galvanizing of steel elements, in which the treatment bath is constituted by a zinc-base treatment bath.

6. The process according to claim 1, in which the contact bath is constituted by a lead bath.

7. The process according to claim 2, comprising simultaneously treating several elements and adjusting the current intensity to said elements in an individual manner to maintain at a predetermined constant value the resistance measured between the ends of the section present between the contact bath and the treatment bath.

8. The process according to claim 1, comprising surrounding the elements by a protective sheet at least between the contact bath and the treatment bath.

9. Apparatus for the treatment of continuous elements made of electrically conductive materials comprising a tank containing a treatment bath, a contact bath upstream of said treatment bath, means for drawing said elements through said tank containing the treatment bath and means for heating said elements before their entering into said tank, said treatment bath being an electrically conductive liquid metal, and said means for heating said elements comprising a source of electric current, the poles of which are connected to said treatment bath and to said contact bath through which said elements pass upstream of said treatment bath, respectively, means for establishing a potential of said preliminary electrolyte bath different from the potential of said contact bath and means for periodically reversing relative to a first contact at the level of the preliminary electrolyte bath, the polarity of a second contact, at the level of the contact bath and relative to a third contact at the level of said treatment bath.

10. An apparatus according to claim 9, comprising a preliminary bath, a current source, means for calculatng the difference between a total current intensity supplied to each element in the contact bath and the current intensity back from the preliminary bath, means sensitive to the voltage across the section of the element being between the contact bath and the treatment bath, means to calculate the resitance of said section from said distance and said voltage, and means to control the current source to maintain said resistance constant.

* * * * *

UNITED STATES PATENT AND TRADEMARK OFFICE

CERTIFICATE OF CORRECTION

PATENT NO. : 4,714,626

DATED : December 22, 1987

INVENTOR(S) : André Poncelet, et al.

It is certified that error appears in the above-identified patent and that said Letters Patent is hereby corrected as shown below:

Column 2, line 39 for "throught" read -- through --.

Column 2, line 44 for "traitement" read -- treatment --.

Column 3, line 61 for "istallation" read -- installation --.

Column 4, line 33 for "lenght" read -- length --.

Column 6, line 4 for "lenght" read -- length --.

UNITED STATES PATENT AND TRADEMARK OFFICE

CERTIFICATE OF CORRECTION

PATENT NO. : 4,714,626

DATED : December 22, 1987

INVENTOR(S) : André Poncelet, et al.

It is certified that error appears in the above-identified patent and that said Letters Patent is hereby corrected as shown below:

Column 2, line 7 for "leading" read -- leading --.

Column 2, line 9 for "wrongly" read -- strongly --.

Column 6, line 24 for "diameter." read -- diameter, --.

Column 8, line 24 for "resitance" read -- resistance --.

Signed and Sealed this

Twenty-eighth Day of March, 1989

*Attest:*

*Attesting Officer*

DONALD J. QUIGG

*Commissioner of Patents and Trademarks*